US011774133B2

(12) United States Patent
Tobbe et al.

(10) Patent No.: US 11,774,133 B2
(45) Date of Patent: Oct. 3, 2023

(54) AIR CONDITIONING APPLIANCE HAVING A PLENUM FOR MAKE-UP AIR

(71) Applicant: Haier US Appliance Solutions, Inc., Wilmington, DE (US)

(72) Inventors: Joseph Robert Tobbe, Louisville, KY (US); Richard Michael Phillips, Louisville, KY (US); Eric Ormsby Sakal, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 43 days.

(21) Appl. No.: 17/406,623

(22) Filed: Aug. 19, 2021

(65) Prior Publication Data

US 2023/0059931 A1 Feb. 23, 2023

(51) Int. Cl.
*F24F 12/00* (2006.01)
*F24F 13/02* (2006.01)

(52) U.S. Cl.
CPC ..... *F24F 12/006* (2013.01); *F24F 13/02* (2013.01); *F24F 2012/007* (2013.01)

(58) Field of Classification Search
CPC ..... F24F 1/028; F24F 1/035; F24F 13/0263; F24F 13/10; F24F 13/28
USPC ..... 165/53
See application file for complete search history.

(56) References Cited

U.S. PATENT DOCUMENTS

| | | | | |
|---|---|---|---|---|
| 2,722,810 | A | 11/1955 | Maniscalco, Sr. | |
| 6,065,296 | A | 5/2000 | Feger | |
| 6,571,572 | B2 | 6/2003 | Fay | |
| 7,942,193 | B2 | 5/2011 | Caldwell | |
| 8,701,431 | B2 | 4/2014 | Jeung | |
| 9,816,724 | B2 | 11/2017 | Clark | |
| 2018/0278128 | A1* | 9/2018 | Okuaki | H05K 7/20181 |
| 2020/0278128 | A1* | 9/2020 | Patel | F24F 1/0375 |
| 2020/0393163 | A1 | 12/2020 | Geisen | |

FOREIGN PATENT DOCUMENTS

| | | | |
|---|---|---|---|
| CN | 101109544 | A | 1/2008 |

* cited by examiner

*Primary Examiner* — Steve S Tanenbaum
(74) *Attorney, Agent, or Firm* — Dority & Manning, P.A.

(57) ABSTRACT

A single-package air conditioner unit may include a housing, an outdoor heat exchanger assembly, an indoor heat exchanger assembly, a compressor, and a plenum. The housing may define an outdoor portion and an indoor portion. The plenum may be attached to the housing and receivable within a wall channel defined by a structure wall. The plenum may define a primary air channel and a make-up air (MUA) inlet in fluid parallel with the primary air channel. The primary air channel may be disposed in fluid communication with the outdoor portion to permit air therebetween. The MUA inlet may be in fluid communication with the indoor portion to permit air thereto.

20 Claims, 10 Drawing Sheets

AIR CONDITIONING APPLIANCE HAVING A PLENUM FOR MAKE-UP AIR

FIELD OF THE INVENTION

The present subject matter relates generally to air conditioning appliances, and more particularly to air conditioning appliances having a plenum for providing make-up air to the appliance or corresponding room.

BACKGROUND OF THE INVENTION

Air conditioner or air conditioning appliance units are conventionally used to adjust the temperature within structures such as dwellings and office buildings. In particular, one-unit type room air conditioner units, such as single-package vertical units (SPVU), may be used to adjust the temperature in, for example, a single room or group of rooms of a structure. A typical one-unit type air conditioner or air conditioning appliance includes an indoor portion and an outdoor portion. The indoor portion generally communicates (e.g., exchanges air) with the area within a building, and the outdoor portion generally communicates (e.g., exchanges air) with the area outside a building. Accordingly, the air conditioner unit generally extends through, for example, an outer wall of the structure. Generally, a fan may be operable to rotate to motivate air through the indoor portion. Another fan may be operable to rotate to motivate air through the outdoor portion. A sealed cooling system including a compressor is generally housed within the air conditioner unit to treat (e.g., cool or heat) air as it is circulated through the indoor portion of the air conditioner unit. One or more control boards are typically provided to direct the operation of various elements of the particular air conditioner unit.

Frequently, the indoor space may need to draw in air from the outdoors (i.e., make-up air). For example, if a vent fan is turned on in a bathroom or air is otherwise ejected from the indoor space, fresh air from the outdoors is required. Depending on, for example, the efficiency of the weather stripping around doors and windows, some make-up air could simply be drawn into the indoors by cracks or other openings. If such cracks are not sufficient, the flow of make-up air may be insufficient or too slow. Furthermore, government regulations, such as fire codes may require that cracks or openings be eliminated as much as possible—precluding a sufficient flow of make-up air.

Accordingly, an air conditioner unit that can allow for the introduction of make-up air into the indoor space would be useful. Unfortunately, previous attempts to provide such make-up air have been unsatisfactory. For example, previous systems ducting make-up air through a housing of the air conditioner unit may make it difficult to meet various government standards (e.g., related to heat management) or have difficulties maintaining various components (e.g., plastic components) within the housing. Separate from or in addition to ducting concerns, existing systems have difficulty preventing liquids (e.g., water spray) from entering into the housing or through make-up air inlets, which may otherwise lead to mildew or damage to various components.

As a result, it would be useful to provide an air conditioning appliance or door assembly that includes features for addressing one or more of the above issues. In particular, it may be advantageous to provide an appliance or assembly with features for supplying make-up air to an air conditioning unit (e.g., while preventing water into the same).

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a single-package air conditioner unit is provided. The single-package air conditioner unit may include a housing, an outdoor heat exchanger assembly, an indoor heat exchanger assembly, a compressor, and a plenum. The housing may define an outdoor portion and an indoor portion. The outdoor heat exchanger assembly may be disposed in the outdoor portion and include an outdoor heat exchanger and an outdoor fan. The indoor heat exchanger assembly may be disposed in the indoor portion and include an indoor heat exchanger and an indoor fan. The compressor may be in fluid communication with the outdoor heat exchanger and the indoor heat exchanger to circulate a refrigerant between the outdoor heat exchanger and the indoor heat exchanger. The plenum may be attached to the housing and receivable within a wall channel defined by a structure wall. The plenum may define a primary air channel and a make-up air (MUA) inlet in fluid parallel with the primary air channel. The primary air channel may be disposed in fluid communication with the outdoor portion to permit air therebetween. The MUA inlet may be in fluid communication with the indoor portion to permit air thereto.

In another exemplary aspect of the present disclosure, a single-package air conditioner unit is provided. The single-package air conditioner unit may include a housing, an outdoor heat exchanger assembly, an indoor heat exchanger assembly, a compressor, a plenum, an angled inlet plate, and a secondary air duct. The housing may define an outdoor portion and an indoor portion. The outdoor heat exchanger assembly may be disposed in the outdoor portion and include an outdoor heat exchanger and an outdoor fan. The indoor heat exchanger assembly may be disposed in the indoor portion and include an indoor heat exchanger and an indoor fan. The compressor may be in fluid communication with the outdoor heat exchanger and the indoor heat exchanger to circulate a refrigerant between the outdoor heat exchanger and the indoor heat exchanger. The plenum may be attached to the housing and receivable within a wall channel defined by a structure wall. The plenum may define a primary air channel and a make-up air (MUA) inlet in fluid parallel with the primary air channel. The primary air channel may be disposed in fluid communication with the outdoor portion to permit air therebetween. The MUA inlet may be in fluid communication with the indoor portion to permit air thereto. The angled inlet plate may extend within the plenum along an inlet angle that is non-orthogonal and non-parallel relative to the transverse direction upstream from the MUA inlet. The secondary air duct may extend from the plenum outside of the housing downstream from the MUA inlet to direct air therefrom.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
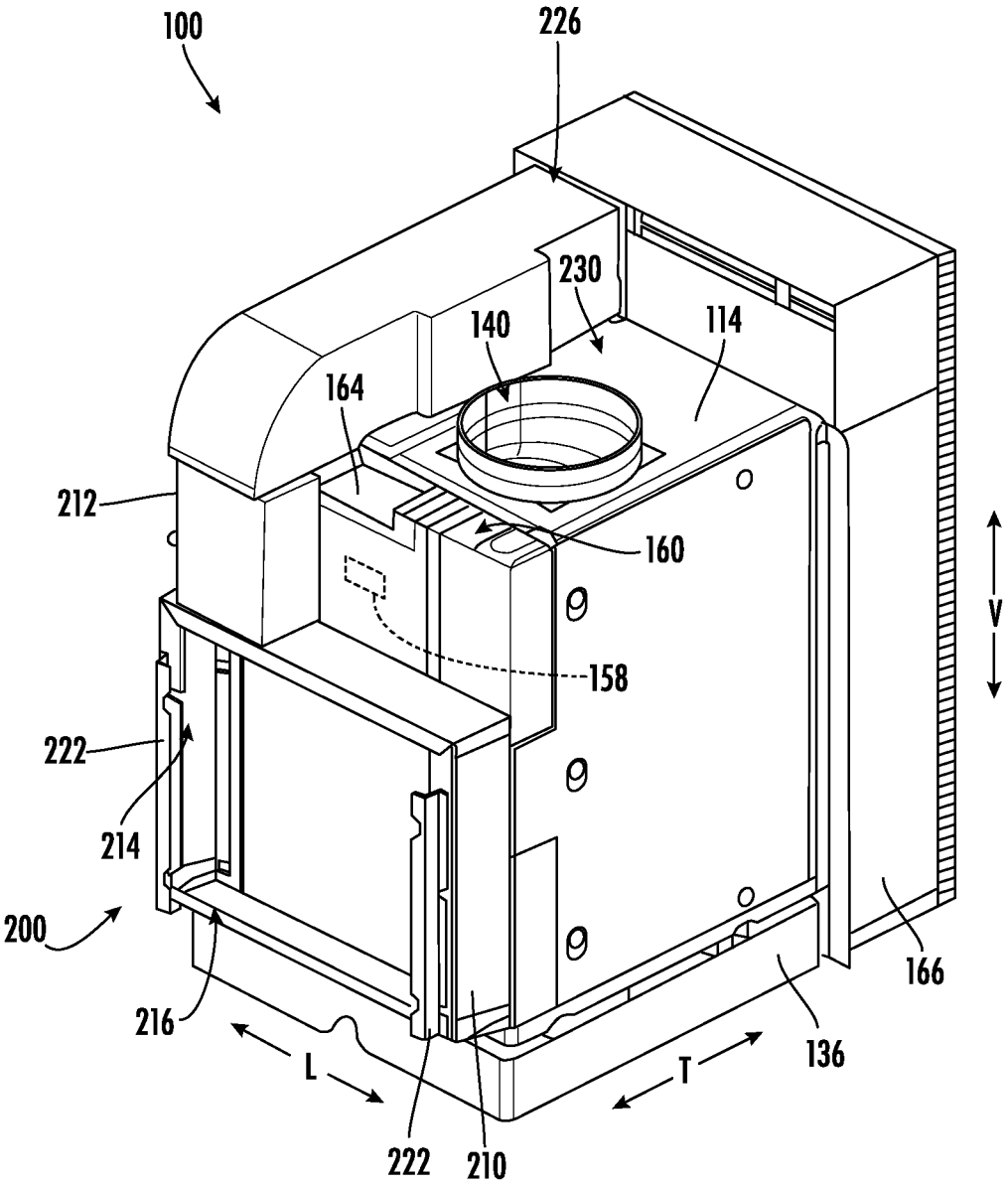
FIG. 1 provides a perspective view of an air conditioning appliance according to exemplary embodiments of the present disclosure.
Figure 2:
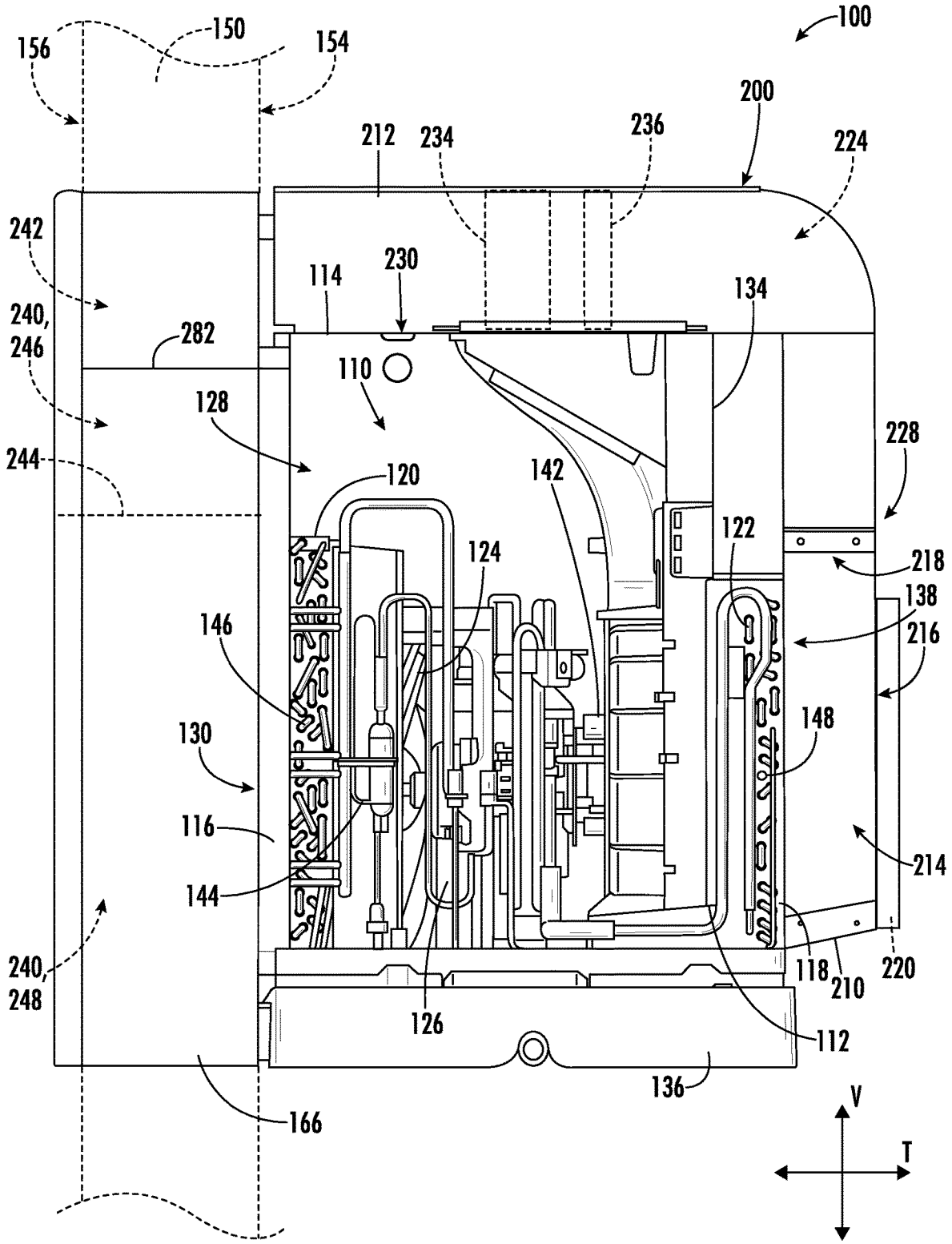
FIG. 2 provides a partially-transparent elevation view of the exemplary air conditioner unit of FIG. 1.
Figure 3:
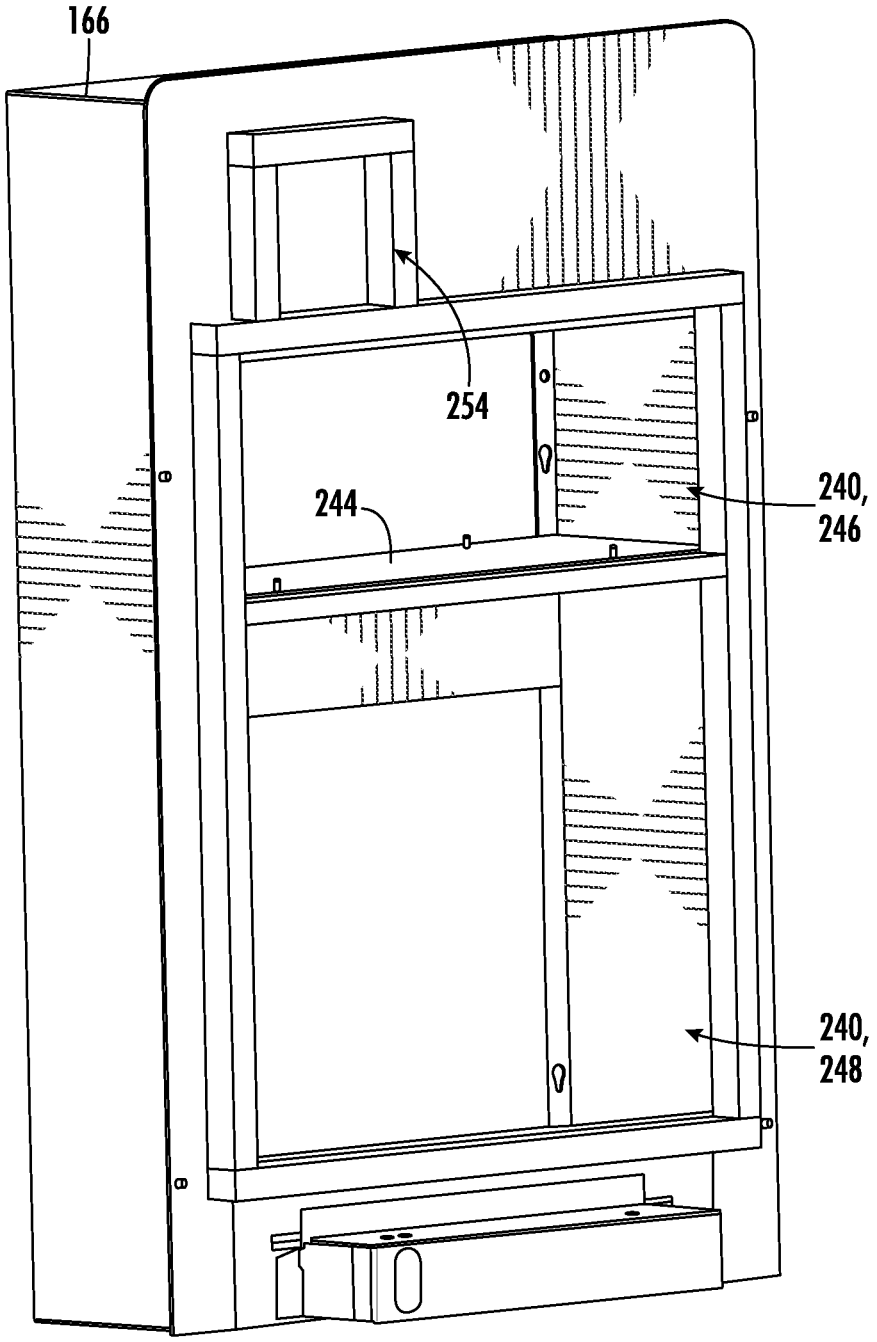
FIG. 3 provides a perspective view of a plenum of an air conditioning appliance according to exemplary embodiments of the present disclosure.
Figure 4:
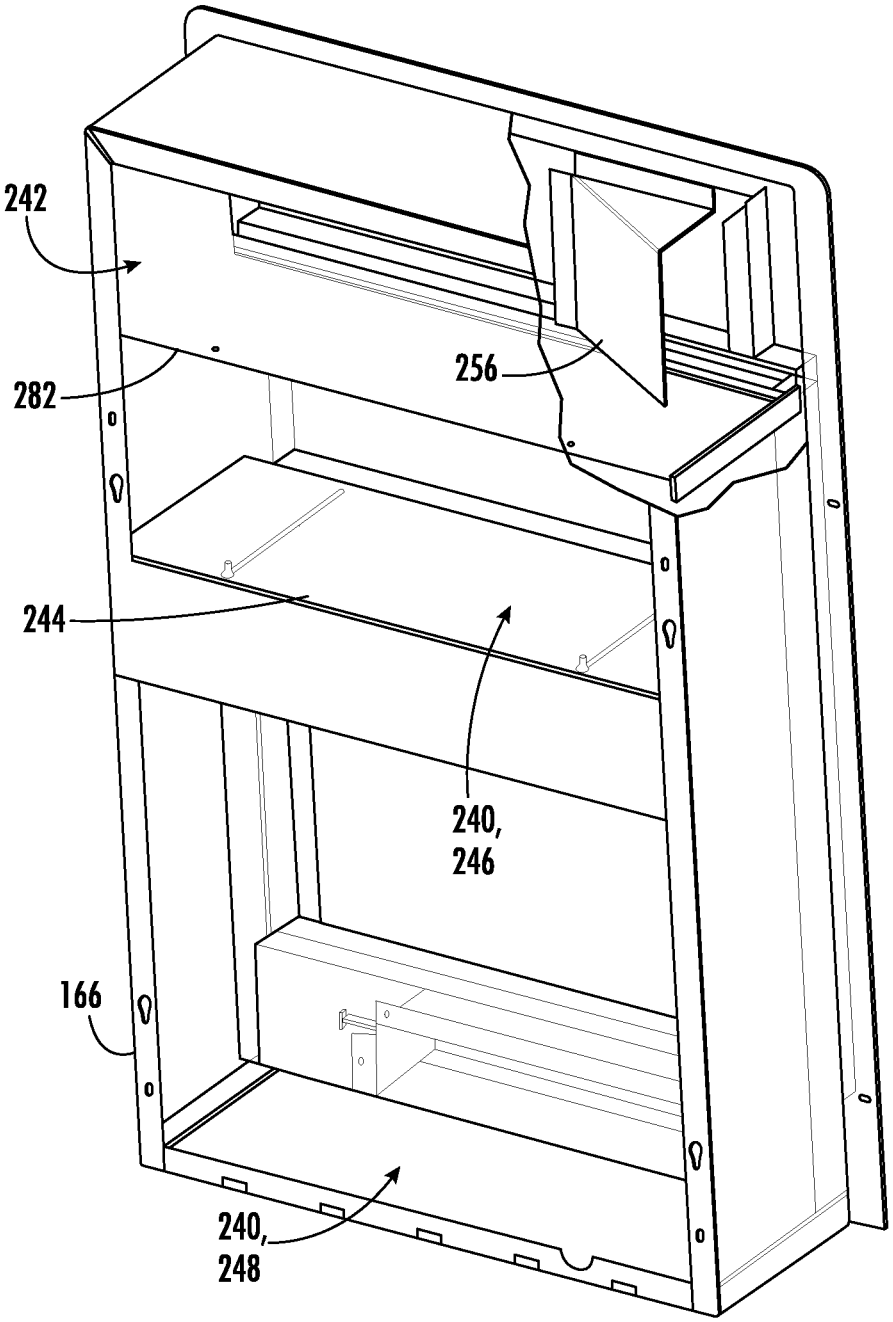
FIG. 4 provides a partially-transparent perspective view of the exemplary plenum of FIG. 3.
Figure 5:
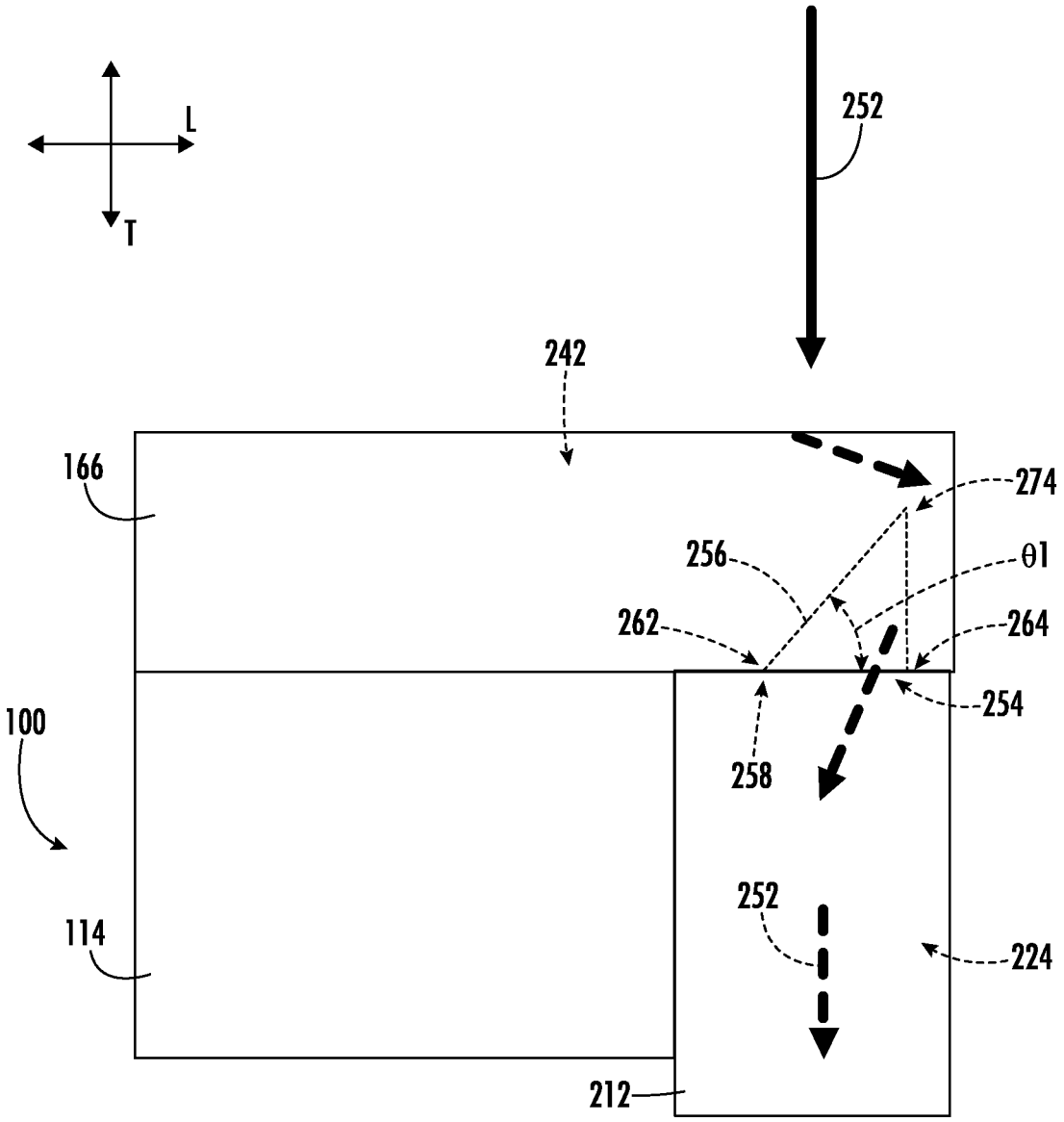
FIG. 5 provides a schematic plan view illustrating airflow through an air conditioner unit having the plenum of FIG. 3.
Figure 6:
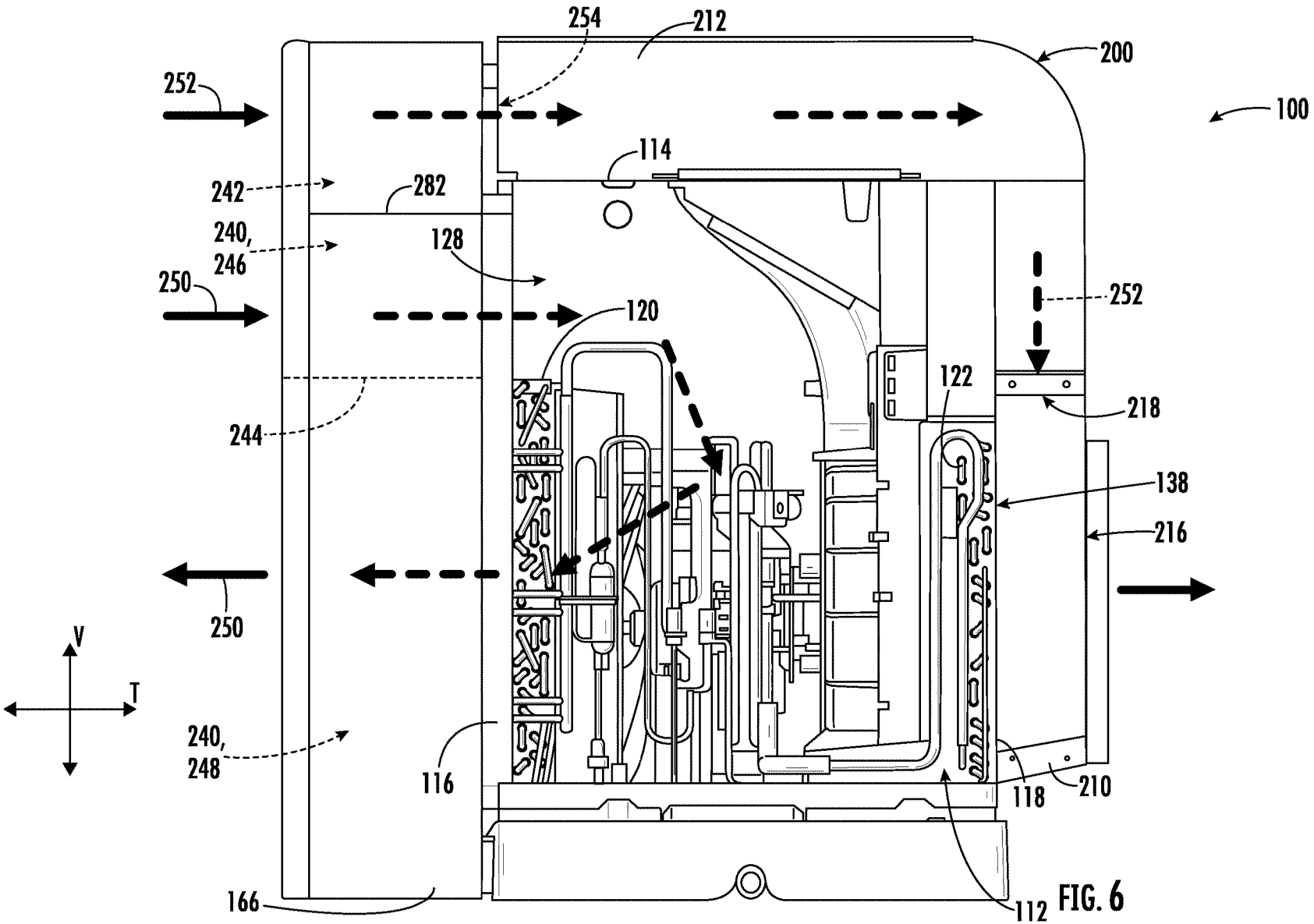
FIG. 6 provides a partially-transparent elevation view of the exemplary air conditioner unit of FIG. 5, illustrating airflow therethrough.
Figure 7:
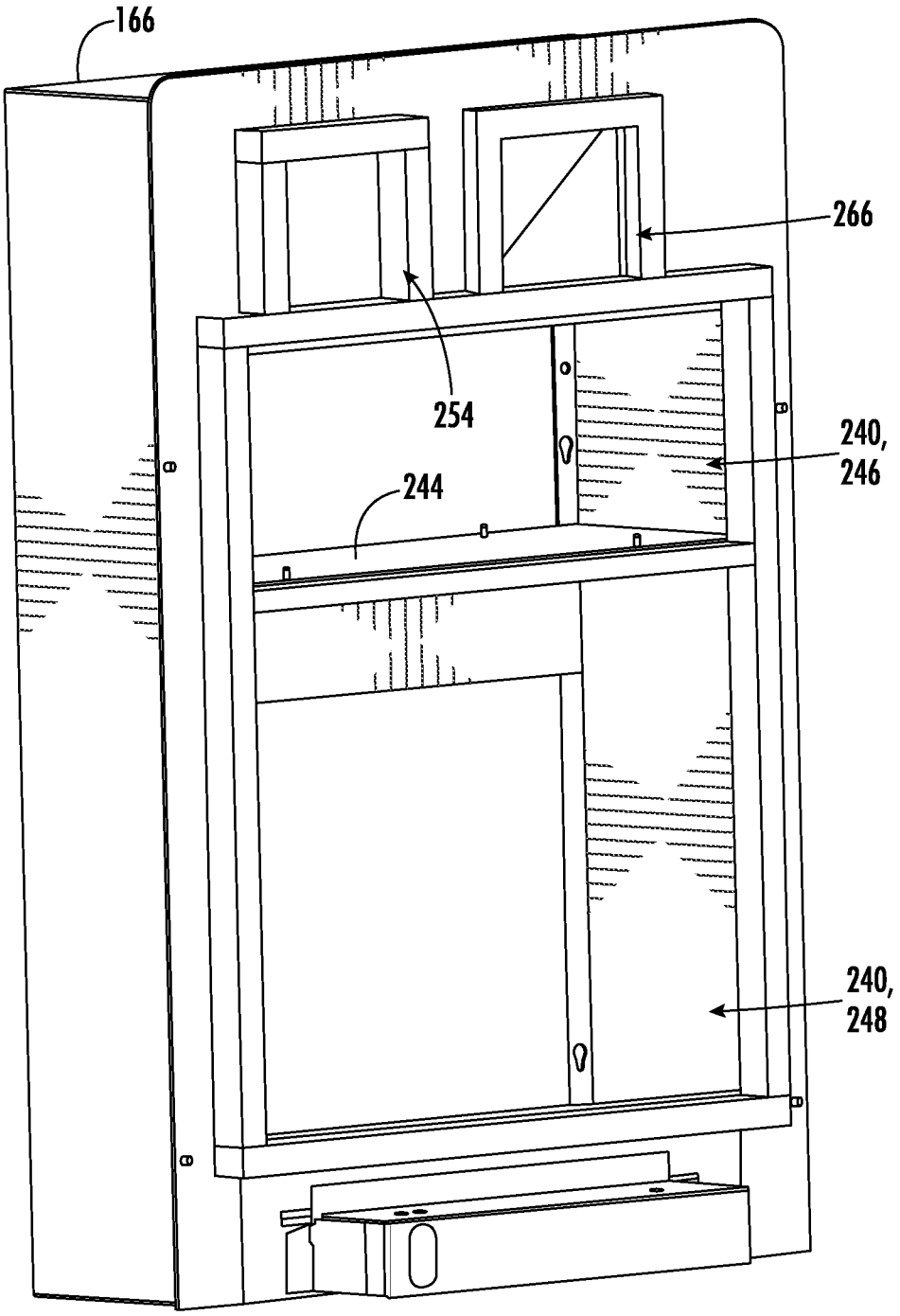
FIG. 7 provides a perspective view of a plenum of an air conditioning appliance according to exemplary embodiments of the present disclosure.
Figure 8:
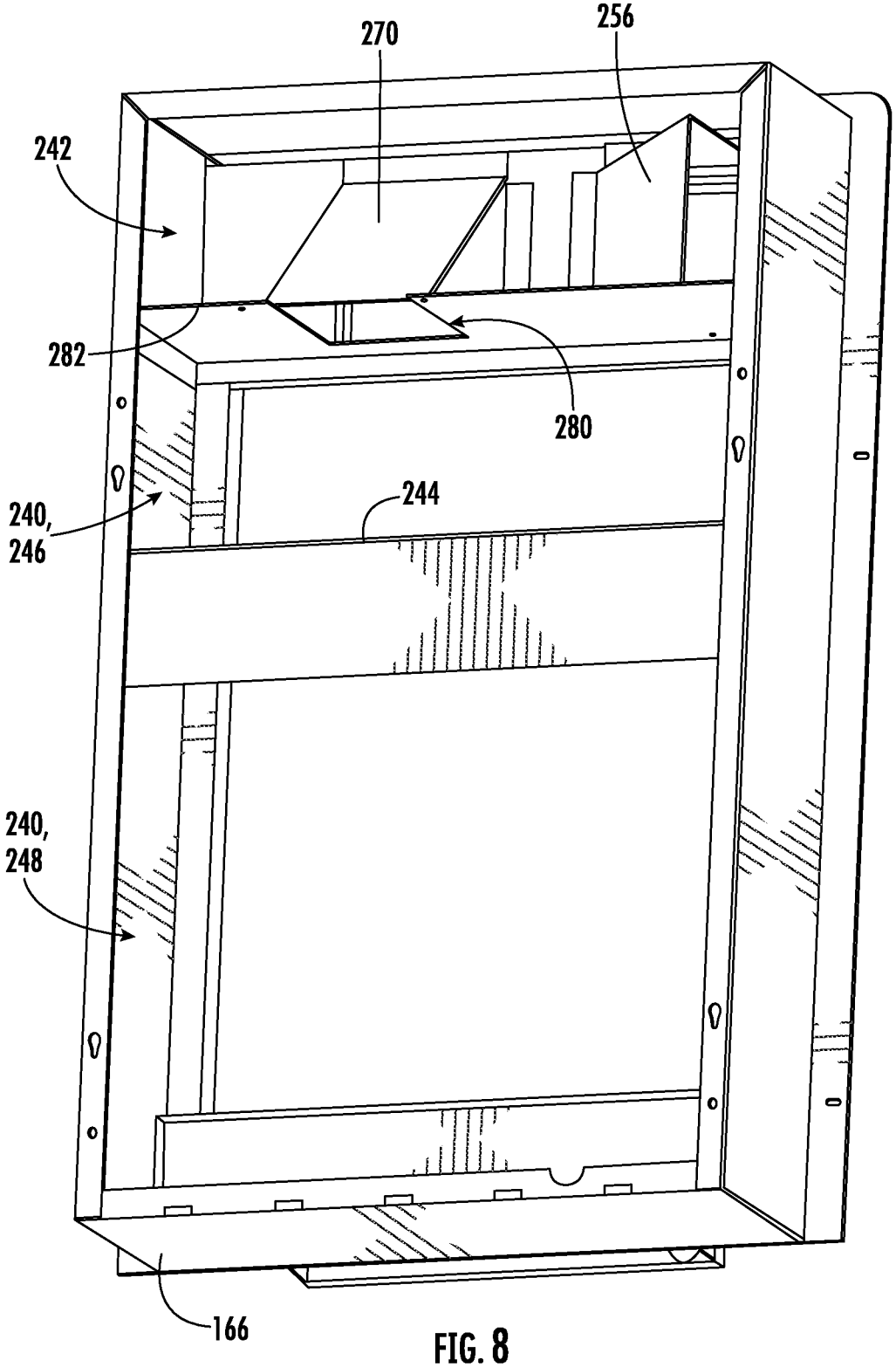
FIG. 8 provides a partially-transparent perspective view of the exemplary plenum of FIG. 3.
Figure 9:
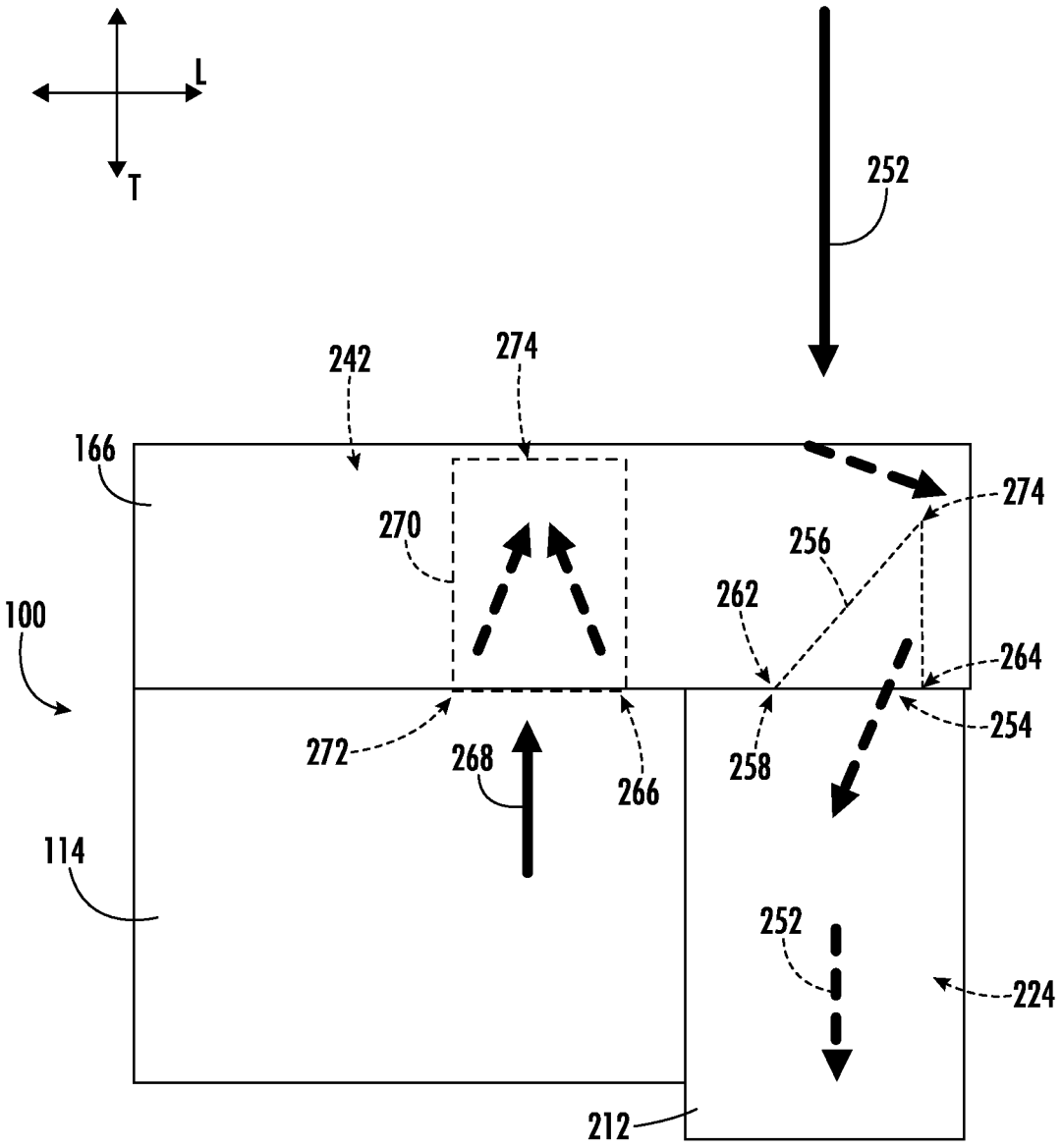
FIG. 9 provides a schematic plan view illustrating airflow through an air conditioner unit having the plenum of FIG. 3.
Figure 10:
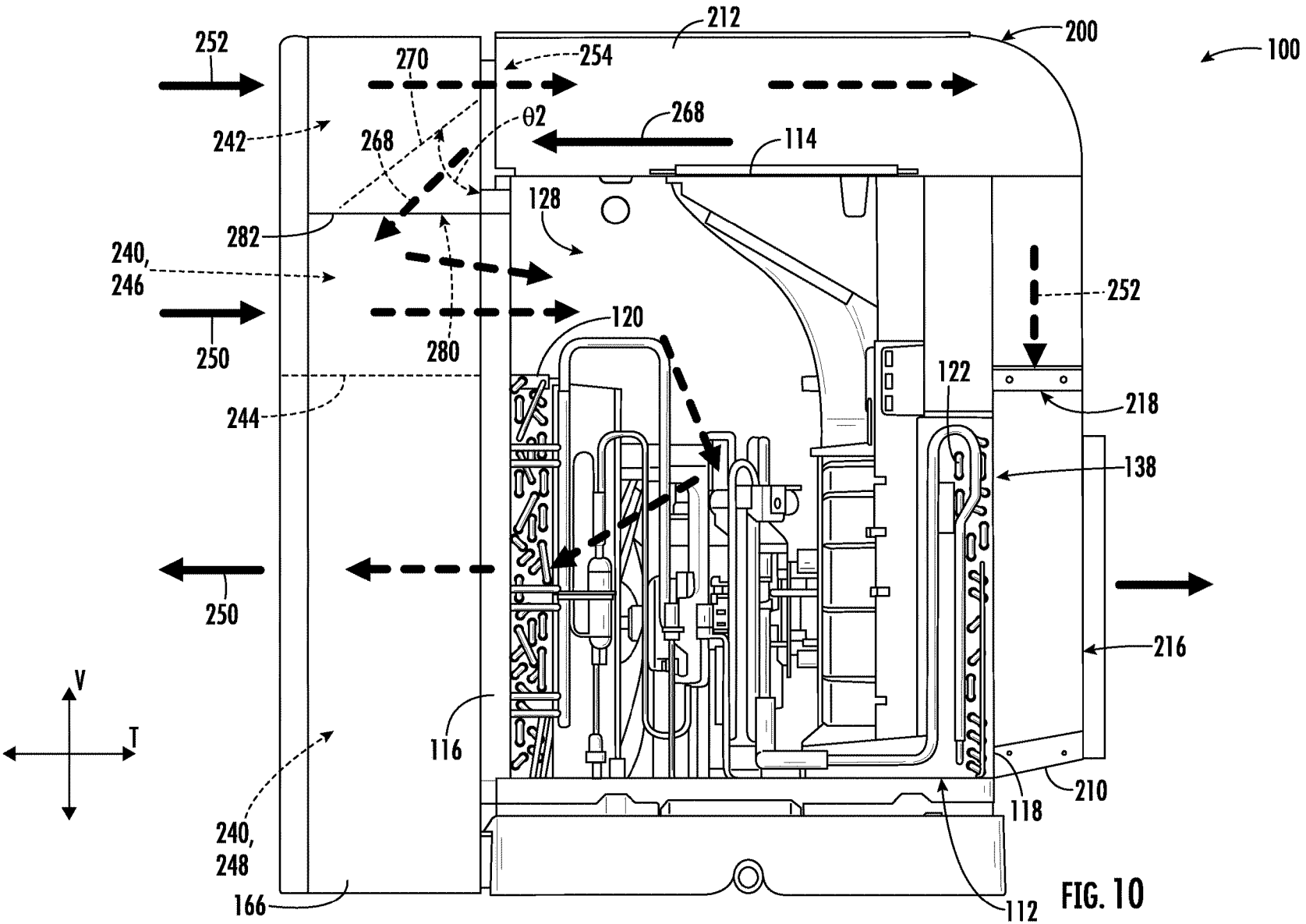
FIG. 10 provides a partially-transparent elevation view of the exemplary air conditioner unit of FIG. 5, illustrating airflow therethrough.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise. The terms "coupled," "fixed," "attached to," and the like refer to both direct coupling, fixing, or attaching, as well as indirect coupling, fixing, or attaching through one or more intermediate components or features, unless otherwise specified herein. The terms "upstream" and "downstream" refer to the relative flow direction with respect to fluid flow in a fluid pathway. For example, "upstream" refers to the flow direction from which the fluid flows, and "downstream" refers to the flow direction to which the fluid flows.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components or systems. For example, the approximating language may refer to being within a 10 percent margin (i.e., including values within ten percent greater or less than the stated value). In this regard, for example, when used in the context of an angle or direction, such terms include within ten degrees greater or less than the stated angle or direction (e.g., "generally vertical" includes forming an angle of up to ten degrees in any direction, such as, clockwise or counterclockwise, with the vertical direction V).

Turning now to the figures, FIG. 1 and illustrate an exemplary air conditioner appliance (e.g., air conditioner 100). As shown, air conditioner 100 may be provided as a one-unit type air conditioner 100, such as a single-package vertical unit. Generally, air conditioner 100 defines a vertical direction V, lateral direction L, and transverse direction T. Each direction V, L, T is perpendicular to each other, such that an orthogonal coordinate system is generally defined.

Air conditioner 100 includes a package housing or cabinet 114 supporting an indoor portion 112 and an outdoor portion 110. In this regard, as used herein, the terms "cabinet," "housing," and the like are generally intended to refer to an outer frame or support structure for appliance 100 (e.g., including any suitable number, type, and configuration of support structures formed from any suitable materials, such as a system of elongated support members, a plurality of interconnected panels, or some combination thereof). It should be appreciated that housing 114 does not necessarily require an enclosure and may simply include open structure supporting various elements of appliance 100. By contrast, housing 114 may enclose some or all portions of an interior of housing 114. It should be appreciated that housing 114 may have any suitable size, shape, and configuration while remaining within the scope of the present subject matter.

In some embodiments, housing 114 contains various other components of the air conditioner 100. Housing 114 may include, for example, a rear opening 116 (e.g., with or without a grill or grate thereacross) and a front opening 118 (e.g., with or without a grill or grate thereacross) may be spaced apart from each other along the transverse direction T. The rear opening 116 may be part of the outdoor portion 110, while the front opening 118 is part of the indoor portion 112. Components of the outdoor portion 110, such as an outdoor heat exchanger 120, outdoor fan 124, and compressor 126 may be enclosed within housing 114 between front opening 118 and rear opening 116. In certain embodiments, one or more components of outdoor portion 110 are mounted on a basepan 136, as shown.

During certain operations, air may be drawn to outdoor portion 110 through rear opening 116. Specifically, an outdoor inlet 128 defined through housing 114 may receive outdoor air motivated by outdoor fan 124. Within housing 114, the received outdoor air may be motivated through or across outdoor fan 124. Moreover, at least a portion of the outdoor air may be motivated through or across outdoor heat exchanger 120 before exiting the rear opening 116 at an outdoor outlet 130. It is noted that although outdoor inlet 128 is illustrated as being defined above outdoor outlet 130, alternative embodiments may reverse this relative orientation (e.g., such that outdoor inlet 128 is defined below outdoor outlet 130) or provide outdoor inlet 128 beside outdoor outlet 130 in a side-by-side orientation, or another suitable discrete orientation.

As shown, indoor portion 112 may include an indoor heat exchanger 122, a blower fan 142, and a heating unit. These components may, for example, be housed behind the front opening 118. A bulkhead 134 may generally support or house various other components or portions thereof of the indoor portion 112, such as the blower fan 142. Bulkhead 134 may generally separate and define the indoor portion 112 and outdoor portion 110 within housing 114. Additionally or alternatively, bulkhead 134 or indoor heat exchanger 122 may be mounted on basepan 136 (e.g., at a higher vertical position than outdoor heat exchanger 120), as shown.

During certain operations, air may be drawn to indoor portion 112 through front opening 118. Specifically, an indoor inlet 138 defined through housing 114 may receive indoor air motivated by blower fan 142. At least a portion of the indoor air may be motivated through or across indoor heat exchanger 122 (e.g., before passing to bulkhead 134). From blower fan 142, indoor air may be motivated (e.g., across heating unit) and returned to the indoor area of the room through an indoor outlet 140 defined through housing 114 (e.g., above indoor inlet 138 along the vertical direction V). Optionally, one or more conduits (not pictured) may be mounted on or downstream from indoor outlet 140 to further guide air from air conditioner 100. It is noted that although indoor outlet 140 is illustrated as generally directing air upward, it is understood that indoor outlet 140 may be defined in alternative embodiments to direct air in any other suitable direction.

Outdoor and indoor heat exchanger 120, 122 may be components of a thermodynamic assembly (i.e., sealed system), which may be operated as a refrigeration assembly (and thus perform a refrigeration cycle) or, in the case of the heat pump unit embodiment, a heat pump (and thus perform a heat pump cycle). Thus, as is understood, exemplary heat pump unit embodiments may be selectively operated perform a refrigeration cycle at certain instances (e.g., while in a cooling mode) and a heat pump cycle at other instances (e.g., while in a heating mode). By contrast, exemplary A/C exclusive unit embodiments may be unable to perform a heat pump cycle (e.g., while in the heating mode), but still perform a refrigeration cycle (e.g., while in a cooling mode).

The sealed system may, for example, further include compressor 126 (e.g., mounted on basepan 136) and an expansion device (e.g., expansion valve or capillary tube—not pictured), both of which may be in fluid communication with the heat exchangers 120, 122 to flow refrigerant therethrough, as is generally understood. The outdoor and indoor heat exchanger 120, 122 may each include coils 146, 148, as illustrated, through which a refrigerant may flow for heat exchange purposes, as is generally understood.

A plenum 166 may be provided to direct air to or from housing 114. When installed, plenum 166 may be selectively attached to (e.g., fixed to or mounted against) housing 114 (e.g., via a suitable mechanical fastener, adhesive, gasket, etc.) and extend through a structure wall 150 (e.g., an outer wall of the structure within which air conditioner 100 is installed). For instance, plenum 166 may extend (e.g., parallel to the transverse direction T) through a hole or channel 152 in the structure wall 150 that passes from an internal surface 154 to an external surface 156.

As will be described in greater detail below, a make-up air assembly 200 may be provided to selectively direct outdoor or make-up air to the indoor portion 112. Specifically, make-up air assembly 200 may direct outdoor air through the structure outer or wall 150 of the structure within which air conditioner 100 is installed (e.g., via plenum 166) and to indoor heat exchanger 122 without first directing such outdoor or make-up air through housing 114. To that end, make-up air assembly 200 may include one or more air ducts or conduits (e.g., intake conduit 210 or secondary air duct 212) defining one or more air paths outside of housing 114. During use, the flow of make-up air may thus be fluidly isolated from the flow of air through outdoor portion 110.

In some embodiments, a make-up air assembly 200 is provided to selectively direct outdoor or make-up air to the indoor portion 112. Specifically, make-up air assembly 200 may direct outdoor air through the structure outer or wall 150 of the structure within which air conditioner 100 is installed (e.g., via plenum 166) and to indoor heat exchanger 122 without first directing such outdoor or make-up air through housing 114. To that end, make-up air assembly 200 may include one or more air ducts or conduits (e.g., intake conduit 210 or secondary air duct 212) defining one or more air paths outside of housing 114. During use, the flow of make-up air may thus be fluidly isolated from the flow of air through outdoor portion 110.

The operation of air conditioner 100 including compressor 126 (and thus the sealed system generally), blower fan 142, outdoor fan 124, heating unit, and other suitable components may be controlled by a controller 158 (e.g., control board, inverter board, etc.). Controller 158 may be in communication (via for example a suitable wired or wireless connection) to such components of the air conditioner 100. By way of example, the controller 158 may include one or more electronics boards (e.g., mounted together or separately within housing 114). In some embodiments, controller 158 includes a memory and one or more processing devices such as microprocessors, CPUs or the like, such as general or special purpose microprocessors operable to execute programming instructions or micro-control code associated with operation of air conditioner 100. The memory may be a separate component from the processor or may be included onboard within the processor. The memory may represent random access memory such as DRAM, or read only memory such as ROM or FLASH.

Air conditioner 100 may additionally include a control panel 160 and one or more user inputs 162, which may be included in control panel 160. The user inputs 162 may be in communication with the controller 158. A user of the air conditioner 100 may interact with the user inputs 162 to operate the air conditioner 100, and user commands may be transmitted between the user inputs 162 and controller 158 to facilitate operation of the air conditioner 100 based on such user commands. A display 164 may additionally be provided in the control panel 160, and may be in communication with the controller 158. Display 164 may, for example be a touchscreen or other text-readable display screen, or alternatively may simply be a light that can be activated and deactivated as required to provide an indication of, for example, an event or setting for the air conditioner 100.

Turning now generally to FIGS. 2 through 10, a plenum 166 and make-up air assembly 200 according to exemplary embodiments will be described in greater detail. As noted above, make-up air assembly 200 may be generally provided to selectively direct outdoor air to the indoor portion 112. To that end, make-up air assembly 200 may be provided or in downstream communication with at least a portion of plenum 166. Plenum 166 itself may define multiple discrete air channels to separately direct air to discrete portions of air conditioner 100. In particular, plenum 166 may define a discrete primary air channel 240 and secondary air channel 242 (e.g., separated or delineated by a dividing wall 282).

When assembled, primary air channel 240 is fluid communication with outdoor portion 110 to permit air (e.g., as part of an outdoor airflow 250) to/from outdoor portion 110. In some embodiments, primary air channel 240 extends coaxially with plenum 166, generally. In additional or alternative embodiments, primary air channel 240 is aligned with outdoor portion 110 (e.g., at the same height). Optionally, plenum 166 may include a divider wall 244 within primary air channel 240. When assembled, divider wall 244 defines a separate upper passage 246 and lower passage 248. For instance, divider wall 244 may extend along the lateral direction L from one lateral side of plenum 166 to the other lateral side. Generally, upper passage 246 and lower passage 248 may divide or define two discrete air flow paths for primary air channel 240. For instance, upper passage 246 may be defined within plenum 166 above divider wall 244. Similarly, lower passage 248 may be defined within plenum 166 below divider wall 244. When assembled, upper passage 246 and lower passage 248 may be fluidly isolated by divider wall 244 (e.g., such that air is prevented from passing directly between passages 246 and 248 through divider wall 244, or another portion of plenum 166). Upper passage 246 may be positioned upstream from outdoor inlet 128. Lower passage 248 may be positioned downstream from outdoor outlet 130. During use, primary air channel 240 may thus permit an outdoor airflow 250 to flow through upper passage 246 and to outdoor portion 110 before the outdoor airflow 250 is motivated across outdoor heat exchanger 120 or otherwise expelled from outdoor portion 110 (e.g., through lower passage 248).

Separately from primary air channel 240, secondary air channel 242 may be defined in fluid communication with indoor portion 112 to permit air therebetween. In the illustrated embodiments secondary air channel 242 defines at least one make-up air (MUA) inlet 254 apart from primary air channel 240. Specifically, MUA inlet 254 is defined in fluid parallel to primary air channel 240. In turn, a make-up airflow 252 of outdoor air (e.g., from the outside ambient environment) may be permitted to flow through MUA inlet 254 separately from outdoor airflow 250.

MUA inlet 254 may be spaced apart from primary air channel 240. For instance, MUA inlet 254 may be located radially outward from primary air channel 240 (e.g., in geometric parallel to the same). In the illustrated embodiments, MUA inlet 254 is located above primary air channel 240. Optionally, MUA inlet 254 may further be disposed apart from the outdoor portion 110. As an example, MUA inlet 254 may be spaced apart from the outdoor portion 110. In some such embodiments, MUA inlet 254 (or secondary air channel 242 generally) is held above (e.g., at a higher vertical height than) outdoor portion 110. Dividing wall 282 may thus be disposed between primary air channel 240 and secondary air channel 242 relative to the vertical direction V.

Although MUA inlet 254 may generally extend through plenum 166 (e.g., parallel to the transverse direction T or primary air channel 240), an angled inlet plate 256 upstream from MUA inlet 254 may direct make-up airflow 252 along a nonlinear path, as will be described below. Angled inlet plate 256 itself may be disposed within plenum 166. In particular, angled inlet plate 256 may extend across at least a portion of MUA inlet 254. For instance, angled inlet plate 256 may extend along an inlet angle θ1 that is non-orthogonal and non-parallel relative to the transverse direction T. In other words, angled inlet plate 256 may form one or more planar surfaces that lie in a plane on the inlet angle θ1. Optionally, the inlet angle θ1 may be between approximately 30° and 60° (e.g., relative to the transverse direction T). Additionally or alternatively, the inlet angle θ1 may be approximately 45°. In optional embodiments, angled inlet plate 256 may cover MUA inlet 254 perpendicular to the transverse direction T. For instance, angled inlet plate 256 may extend from a first plate end 258 that is proximal to the MUA inlet 254 at one lateral side 262 to a second plate end 260 that is distal to the MUA inlet 254 while being aligned with or laterally outward from the opposite lateral side 264 of MUA inlet 254. Thus, when viewed along the transverse direction T (e.g., from the outside), MUA inlet 254 may be visually obscured. Moreover, air entering MUA inlet 254 may be forced to flow along a curved or nonlinear path around angled inlet plate 256.

Notably, liquid sprayed toward MUA inlet 254 or plenum 166 generally (e.g., from the outside or ambient environment) may be blocked by angled inlet plate 256 while air is still permitted around the same.

Downstream from MUA inlet 254, make-up air assembly 200 may include an intake conduit 210 that defines an intake passage 214 upstream from indoor inlet 138. As shown, intake conduit 210 extends outward from housing 114. For instance, intake passage 214 may extend along a passage axis (e.g., horizontal or parallel to the transverse direction T), which the intake conduit 210 generally surrounds or radially bounds. In some such embodiments, intake passage 214 is parallel to passage axis. When assembled, intake conduit 210 may be mounted to housing 114, such as on an outer surface 230 of housing 114. In turn, intake passage 214 may extend from a primary air inlet 216 (i.e., primary inlet), which is defined as an opening or aperture of intake conduit 210, to indoor inlet 138. Thus, primary air inlet 216 is spaced apart from indoor inlet 138 (e.g., along the transverse direction T). In some embodiments, primary air inlet 216 is coaxial with indoor inlet 138. For instance, both primary air inlet 216 and indoor inlet 138 may be defined along the passage axis. In turn, intake passage 214 may be a linear passage from primary air inlet 216 to indoor inlet 138.

Along with defining primary air inlet 216, intake conduit 210 may define a secondary air inlet 218 (i.e., secondary inlet). Optionally, secondary air inlet 218 may be defined separate from primary air inlet 216. When assembled, secondary air inlet 218 may be spaced apart from primary air inlet 216. For instance, secondary air inlet 218 may be defined in fluid parallel to primary air inlet 216. Thus, airflow through secondary air inlet 218 to intake passage 214 may be distinct from airflow through primary air inlet 216. Moreover, upstream from intake passage 214, the airflows through secondary air inlet 218 and primary air inlet 216 may be independent from (i.e., not commingled with) each other.

In some embodiments, secondary air inlet 218 is defined along a non-parallel angle relative to primary air inlet 216 (i.e., such that primary air inlet 216 and secondary air inlet 218 are not defined along geometric parallel axes). For instance, secondary air inlet 218 may be defined through intake conduit 210 perpendicular to primary air inlet 216 (e.g., perpendicular to passage axis or transverse direction T). In optional embodiments, secondary air inlet 218 is defined above primary air inlet 216. Thus, airflow through secondary air inlet 218 to intake passage 214 may flow downward. In additional or alternative embodiments, secondary air inlet 218 is closer to indoor inlet 138 (e.g., relative to the passage axis or transverse direction T) than primary air inlet 216. Thus, secondary air inlet 218 may be proximal to indoor inlet 138 while primary air inlet 216 is distal to indoor inlet 138. Optionally, the airflow cross section of secondary air inlet 218 may less than the airflow cross section of primary air inlet 216.

In optional embodiments, a filter panel 220 may be disposed (e.g., selectively or removably disposed) on intake conduit 210. In particular, filter panel 220 may be disposed in fluid communication with intake passage 214 to filter air thereto. For instance, filter panel 220 may be in fluid communication with primary air inlet 216 while being spaced apart from secondary air inlet 218. During use, airflow to intake passage 214 through primary air inlet 216 may thus be forced through filter panel 220 in order to flow to intake passage 214. By contrast, airflow (e.g., make-up airflow 252) to intake passage 214 through secondary air inlet 218 may advantageously bypass filter panel 220 altogether. Optionally, indoor inlet 138 may be unobstructed by any filtration media, ensuring a direct flow path from intake passage 214 to the indoor portion 112. Notably, bypassing filter panel 220 may prevent significant resistance to make-up air (e.g., while ensuring filtration of most of the airflow, such as the non-makeup airflow to indoor inlet 138).

In some embodiments, filter panel 220 is disposed in front primary air inlet 216 (e.g., along the transverse direction T or otherwise outside from intake passage 214). Moreover, filter panel 220 may be upstream from primary air inlet 216. One or more mounting brackets 222 may be provided to hold filter panel 220 on intake conduit 210. For instance, as illustrated, a pair of mounting brackets 222 that each defining a discrete support channel to slidably receive filter panel 220 may be provided on opposite ends (e.g., opposite lateral ends or vertical ends) of intake conduit 210 or primary air inlet 216. As shown, each mounting bracket 222 may be opened at one end (e.g., a top end) while being closed at an opposite end (e.g., a bottom end) to support filter panel 220 or otherwise prevent filter panel 220 from sliding directly through (i.e., out of) the mounting brackets 222 during installation of filter panel 220 on intake conduit 210. Filter panel 220 itself may be provided as any suitable frame or structure including a suitable air filtration media (e.g., cellulose, fiberglass, foam, etc.).

In some embodiments, a secondary air duct 212 is mounted or attached to intake conduit 210 to direct outdoor (i.e., make-up) air to secondary air inlet 218. Thus, secondary air duct 212 may be disposed upstream from secondary air inlet 218 to direct air thereto. Moreover, secondary air duct 212 may define a secondary passage 224 that extends from an outdoor end 226 to an indoor end 228. In certain embodiments, outdoor end 226 is positioned at or proximal to plenum 166 while indoor end 228 is positioned at or proximal to secondary air inlet 218, as shown.

When assembled, secondary air duct 212 may extend from intake conduit 210 outside of housing 114. Thus, secondary passage 224 may be defined outside of housing 114 apart from indoor portion 112 and outdoor portion 110. In certain embodiments, secondary air duct 212 is disposed on outer surface 230 of housing 114. Thus, while secondary air duct 212 is separate from housing 114, secondary air duct 212 may be held to housing 114 (e.g., as a single unit) without commingling air through outdoor portion 110 and secondary passage 224, or without motivating air within housing 114 across an exterior surface of secondary air duct 212 (e.g., opposite from the interior secondary passage 224).

Outdoor end 226 of secondary air duct 212 defines a duct intake 232 through which outdoor or make-up air may enter secondary passage 224. In certain embodiments, duct intake 232 may be disposed directly above the outdoor outlet 130 (e.g., at the plenum 166). In order to direct air from an outdoor region to intake conduit 210, duct intake 232 is generally offset or spaced apart from secondary air inlet 218 in or along at least one direction (e.g., the transverse direction T). As shown, duct intake 232 may further be offset from secondary air inlet 218 in a second direction (e.g., in the vertical direction V or lateral direction L). In the illustrated embodiments, indoor end 228 (and thus secondary air inlet 218) is both horizontally and vertically offset from duct intake 232. For instance, secondary air inlet 218 may be transversely offset and lower than the duct intake 232. Airflow through secondary passage 224 may thus be drawn forward and downward, notably maintaining a compact assembly while minimizing the resistance of airflow through secondary passage 224.

In some embodiments, one or more movable airflow elements may be disposed or mounted within secondary air duct 212 to selectively motivate or restrict airflow through secondary passage 224. As an example, a make-up fan 234 (e.g., axial fan, tangential fan, etc.) may be mounted within secondary air duct 212 to selectively direct air therethrough. In some such embodiments, controller 158 is in operable (e.g., electric or wireless) communication with make-up fan 234. During operation, controller 158 may thus selectively activate or initiate rotation of make-up fan 234 to motivate make-up air to intake conduit 210. As an additional or alternative example, a damper door 236 may be movably mounted in the secondary air duct 212 to selectively permit air therethrough. In some such embodiments, controller 158 is in operable (e.g., electric or wireless) communication with damper door 236 (e.g., a motor thereof). During operation, controller 158 may thus selectively activate or initiate movement of damper door 236 to an open position to permit motivate make-up air to intake conduit 210. Moreover, controller 158 may separately activate or initiate movement of damper door 236 to a closed position to restrict airflow through secondary air duct 212 (e.g., when make-up air is not desired).

Turning especially to FIGS. 7 through 10, in further embodiments, a predefined exhaust for air from the corresponding room may be provided (i.e., downstream from the room and, thus, intake conduit 210 or indoor portion 112, generally. For instance, plenum 166 may define an equalizing air (EA) exhaust 266 within the secondary air channel 242. In particular, EA exhaust 266 may be spaced apart from the MUA inlet 254 (e.g., laterally). In turn, an equalizing airflow 268 from the room may be permitted to flow through EA exhaust 266 separately from the make-up airflow 252. Optionally, EA exhaust 266 may further be disposed apart from the outdoor portion 110. For instance, EA exhaust 266 may be defined above outdoor portion 110.

In certain embodiments, though, EA exhaust 266 may communicate with primary air channel 240 or outdoor portion 110 generally. Specifically, an angled exhaust plate 270 downstream from EA exhaust 266 may direct equalizing airflow 268 directly to the outdoor airflow 250, as will be described below. Angled exhaust plate 270 may extend across at least a portion of EA exhaust 266. For instance, angled exhaust plate 270 may extend along an exhaust angle θ2 that is non-orthogonal and non-parallel relative to the vertical direction V. In other words, angled inlet plate 256 may form one or more planar surfaces that lie in a plane on the exhaust angle θ2. Optionally, the exhaust angle θ2 may be between approximately 30° and 60° (e.g., relative to the vertical direction V). Additionally or alternatively, the exhaust angle θ2 may be approximately 45°. In optional embodiments, angled exhaust plate 270 may cover EA exhaust 266 perpendicular to the transverse direction T. For instance, angled inlet plate 256 may extend from a first plate end 272 that is proximal to the EA exhaust 266 at a top end 276 to a second plate end 274 that is distal to the EA exhaust 266 while being aligned with or below the bottom end 278 of EA exhaust 266. Optionally, a bypass aperture 280 may be defined (e.g., along the vertical direction V) through the dividing wall 282 between primary air channel 240 and secondary air channel 242. Thus, the angled exhaust plate 270 may extend to the primary air channel 240 and upstream therefrom. Furthermore, when viewed along the transverse direction T (e.g., from the outside), EA exhaust 266 may be visually obscured. Air entering EA exhaust 266 may be forced to flow (e.g., downward) to primary air channel 240. Within primary air channel 240 (or outdoor portion 110 generally) the previously condition (e.g., relatively cool) equalizing airflow 268 may mix with the unconditioned (e.g., relatively warm) outdoor airflow 250, advantageously facilitating greater heat transfer than would otherwise be possible from outdoor heat exchanger 120 and improve efficiency of the air conditioner 100.

Additionally or alternatively, it is notable that liquid sprayed toward EA exhaust 266 or plenum 166 generally (e.g., from the outside or ambient environment) may be blocked by angled exhaust plate 270 while air is still permitted around the same.

Advantageously, the above-described embodiments of make-up air assembly 200 may provide or permit efficient make-up airflow (e.g., without create a risk of damage to components within the housing 114).

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A single-package air conditioner unit defining a mutually-perpendicular vertical direction, lateral direction, and transverse direction, the single-package air conditioner unit comprising:

a housing defining an outdoor portion and an indoor portion;

an outdoor heat exchanger assembly disposed in the outdoor portion and comprising an outdoor heat exchanger and an outdoor fan;

an indoor heat exchanger assembly disposed in the indoor portion and comprising an indoor heat exchanger and an indoor fan;

a compressor in fluid communication with the outdoor heat exchanger and the indoor heat exchanger to circulate a refrigerant between the outdoor heat exchanger and the indoor heat exchanger;

a plenum attached to the housing and receivable within a wall channel defined by a structure wall, the plenum defining a primary air channel and a make-up air (MUA) inlet in fluid parallel with the primary air channel, the primary air channel being disposed in fluid communication with the outdoor portion to permit air therebetween, and the MUA inlet being in fluid communication with the indoor portion to permit air thereto; and an intake conduit extending from the housing at the indoor portion downstream from the MUA inlet, the intake conduit defining an intake passage upstream from the indoor heat exchanger assembly, wherein the intake conduit further defines a primary inlet and a secondary inlet spaced apart from the primary inlet in fluid parallel thereto, the primary inlet and the secondary inlet being defined upstream from the intake passage to separately permit air thereto.

2. The single-package air conditioner unit of claim 1, wherein the MUA inlet is spaced apart from the outdoor portion.

3. The single-package air conditioner unit of claim 1, further comprising a secondary air duct extending outside of the housing upstream from the secondary inlet to direct air thereto.

4. The single-package air conditioner unit of claim 1, further comprising an angled inlet plate extending within the plenum along an inlet angle that is non-orthogonal and non-parallel relative to the transverse direction upstream from the MUA inlet.

5. The single-package air conditioner unit of claim 4, wherein the angled inlet plate covers MUA inlet perpendicular to the transverse direction.

6. The single-package air conditioner unit of claim 1, wherein the plenum further defines an equalizing air (EA) exhaust spaced apart from the MUA inlet to receive air downstream from the indoor portion.

7. The single-package air conditioner unit of claim 6, further comprising an angled exhaust plate extending within the plenum along an exhaust angle that is non-orthogonal and non-parallel relative to the vertical direction downstream from the EA exhaust.

8. The single-package air conditioner unit of claim 7, wherein the angled exhaust plate extends to the primary air channel and upstream therefrom.

9. A single-package air conditioner unit defining a mutually-perpendicular vertical direction, lateral direction, and transverse direction, the single-package air conditioner unit comprising:

a housing defining an outdoor portion and an indoor portion;

an outdoor heat exchanger assembly disposed in the outdoor portion and comprising an outdoor heat exchanger and an outdoor fan;

an indoor heat exchanger assembly disposed in the indoor portion and comprising an indoor heat exchanger and an indoor fan;

a compressor in fluid communication with the outdoor heat exchanger and the indoor heat exchanger to circulate a refrigerant between the outdoor heat exchanger and the indoor heat exchanger;

a plenum attached to the housing and receivable within a wall channel defined by a structure wall, the plenum defining a primary air channel and a make-up air (MUA) inlet in fluid parallel with the primary air channel, the primary air channel being disposed in fluid communication with the outdoor portion to permit air therebetween, and the MUA inlet being in fluid communication with the indoor portion to permit air thereto;

an angled inlet plate extending within the plenum along an inlet angle that is non-orthogonal and non-parallel relative to the transverse direction upstream from the MUA inlet;

a secondary air duct extending from the plenum outside of the housing downstream from the MUA inlet to direct air therefrom; and an intake conduit extending from the housing at the indoor portion downstream from the MUA inlet, the intake conduit defining an intake passage upstream from the indoor heat exchanger assembly, wherein the intake conduit further defines a primary inlet and a secondary inlet spaced apart from the primary inlet in fluid parallel thereto, the primary inlet and the secondary inlet being defined upstream from the intake passage to separately permit air thereto.

10. The single-package air conditioner unit of claim 9, wherein the angled inlet plate covers MUA inlet perpendicular to the transverse direction.

11. The single-package air conditioner unit of claim 9, wherein the MUA inlet is spaced apart from the outdoor portion.

12. The single-package air conditioner unit of claim 9, wherein the plenum further defines an equalizing air (EA) exhaust spaced apart from the MUA inlet to receive air downstream from the indoor portion.

13. The single-package air conditioner unit of claim 12, further comprising an angled exhaust plate extending within the plenum along an exhaust angle that is non-orthogonal and non-parallel relative to the vertical direction downstream from the EA exhaust.

14. The single-package air conditioner unit of claim 13, wherein the angled exhaust plate extends to the primary air channel and upstream therefrom.

15. A single-package air conditioner unit defining a mutually-perpendicular vertical direction, lateral direction, and transverse direction, the single-package air conditioner unit comprising:

a housing defining an outdoor portion and an indoor portion, the housing further defining an outdoor inlet upstream from the outdoor portion and an outdoor outlet downstream from the outdoor portion;

an outdoor heat exchanger assembly disposed in the outdoor portion and comprising an outdoor heat exchanger and an outdoor fan;

an indoor heat exchanger assembly disposed in the indoor portion and comprising an indoor heat exchanger and an indoor fan;

a compressor in fluid communication with the outdoor heat exchanger and the indoor heat exchanger to circulate a refrigerant between the outdoor heat exchanger and the indoor heat exchanger; and a plenum attached to the housing and receivable within a wall channel defined by a structure wall, the plenum defining a primary air channel and a make-up air (MUA) inlet in fluid parallel with the primary air channel, the primary air channel being disposed in fluid communication with the outdoor portion to permit air therebetween, and the MUA inlet being in fluid communication with the indoor portion to permit air thereto, the plenum further comprising a divider wall disposed within the primary air channel and defining a fluidly isolated upper passage and lower passage of the primary air channel, the upper passage being positioned upstream from the outdoor inlet, the lower passage being positioned downstream from the outdoor outlet; and an intake conduit extending from the housing at the indoor portion downstream from the MUA inlet, the intake conduit defining an intake passage upstream from the indoor heat exchanger assembly.

16. The single-package air conditioner unit of claim 15, further comprising an angled inlet plate extending within the plenum along an inlet angle that is non-orthogonal and non-parallel relative to the transverse direction upstream from the MUA inlet.

17. The single-package air conditioner unit of claim 15, wherein the MUA inlet is spaced apart from the outdoor portion.

18. The single-package air conditioner unit of claim 15, wherein the plenum further defines an equalizing air (EA) exhaust spaced apart from the MUA inlet to receive air downstream from the indoor portion.

19. The single-package air conditioner unit of claim 15, wherein the intake conduit further defines a primary inlet and a secondary inlet spaced apart from the primary inlet in fluid parallel thereto, the primary inlet and the secondary inlet being defined upstream from the intake passage to separately permit air thereto.

20. The single-package air conditioner unit of claim 19, further comprising a secondary air duct extending outside of the housing upstream from the secondary inlet to direct air thereto.

* * * * *